US006182740B1

(12) United States Patent
Pfaff

(10) Patent No.: US 6,182,740 B1
(45) Date of Patent: Feb. 6, 2001

(54) PORTABLE ROOM DIVIDER APPARATUS

(76) Inventor: Raymond J. Pfaff, 51 Deerfield Dr., Franklin, NJ (US) 07416

( * ) Notice: Under 35 U.S.C. 154(b), the term of this patent shall be extended for 0 days.

(21) Appl. No.: 09/506,550

(22) Filed: Feb. 18, 2000

(51) Int. Cl.[7] ..... A47G 5/00

(52) U.S. Cl. ..... 160/351; 160/135; 160/350; 160/377

(58) Field of Search ..... 160/350, 351, 160/377, 378, 135

(56) References Cited

U.S. PATENT DOCUMENTS

| | | | | |
|---|---|---|---|---|
| D. 279,942 | * | 8/1985 | Vasquez et al. | D6/332 |
| 1,288,518 | * | 12/1918 | Collier | 160/351 |
| 2,888,072 | * | 5/1959 | Nicholas | 160/351 |
| 3,017,969 | * | 1/1962 | Nielsen | 160/351 |
| 3,605,851 | * | 9/1971 | Miles et al. | 160/351 X |
| 4,085,789 | * | 4/1978 | Steiner et al. | 160/135 |
| 4,121,645 | * | 10/1978 | Behr | 160/135 |
| 4,516,620 | * | 5/1985 | Mulhern | 160/351 |
| 4,784,205 | * | 11/1988 | Johnson et al. | 160/351 |
| 4,842,035 | * | 6/1989 | Thompson | 160/135 |
| 5,070,665 | * | 12/1991 | Marrin et al. | 160/351 X |
| 5,352,149 | * | 10/1994 | Melashenko et al. | 160/351 X |
| 5,553,648 | * | 9/1996 | Goharjou | 160/351 X |
| 5,878,802 | * | 3/1999 | Richter et al. | 160/135 |
| 6,038,802 | * | 3/2000 | Tidwell | 160/377 X |

* cited by examiner

*Primary Examiner*—Bruce A. Lev

(57) ABSTRACT

A portable room divider apparatus for providing privacy in any room, in particular, in any hotel and motel room. The portable room divider apparatus includes a base having a pair of elongate members and a cross member removably interconnecting the elongate members; and also includes a plurality of tubular support members interconnected to the base with T-shaped tubular couplers and interconnected end-to-end with one another with sleeve-like tubular couplers; and further includes a plurality of barrier support members being interconnected end-to-end and being horizontally mounted upon the tubular support members with T-shaped tubular couplers; and also includes a barrier member such as a curtain which is removably mounted to the barrier support members and which has a height of approximately 6 feet and a width of approximately 6 feet.

12 Claims, 4 Drawing Sheets

PORTABLE ROOM DIVIDER APPARATUS

BACKGROUND OF THE INVENTION

1. Field of the Invention

The present invention relates to a portable and height adjustable room divider and more particularly pertains to a new portable room divider apparatus for providing privacy in any room, in particular, in any hotel and motel room.

2. Description of the Prior Art

The use of a portable and height adjustable room divider is known in the prior art. More specifically, a portable and height adjustable room divider heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,842,035; U.S. Pat. No. 5,878,802; U.S. Pat. No. 4,121,645; U.S. Pat. No. 4,085,789; U.S. Pat. No. 4,516,620; and U.S. Pat. No. Des. 279,942.

While these devices fulfill their respective, particular objectives and requirements, the aforementioned patents do not disclose a new portable room divider apparatus. The inventive device includes a base having a pair of elongate members and a cross member removably interconnecting the elongate members; and also includes a plurality of tubular support members interconnected to the base with T-shaped tubular couplers and interconnected endto-end with one another with sleeve-like tubular couplers; and further includes a plurality of barrier support members being interconnected end-to-end and being horizontally mounted upon the tubular support members with T-shaped tubular couplers; and also includes a barrier member such as a curtain which is removably mounted to the barrier support members and which has a height of approximately 6 feet and a width of approximately 6 feet.

In these respects, the portable room divider apparatus according to the present invention substantially departs from the conventional concepts and designs of the prior art, and in so doing provides an apparatus primarily developed for the purpose of providing privacy in any room, in particular, in any hotel and motel room.

SUMMARY OF THE INVENTION

In view of the foregoing disadvantages inherent in the known types of portable and height adjustable room divider now present in the prior art, the present invention provides a new portable room divider apparatus construction wherein the same can be utilized for providing privacy in any room, in particular, in any hotel and motel room.

The general purpose of the present invention, which will be described subsequently in greater detail, is to provide a new portable room divider apparatus which has many of the advantages of the portable and height adjustable room divider mentioned heretofore and many novel features that result in a new portable room divider apparatus which is not anticipated, rendered obvious, suggested, or even implied by any of the prior art portable and height adjustable room divider, either alone or in any combination thereof.

To attain this, the present invention generally comprises a base having a pair of elongate members and a cross member removably interconnecting the elongate members; and also includes a plurality of tubular support members interconnected to the base with T-shaped tubular couplers and interconnected end-to-end with one another with sleeve-like tubular couplers; and further includes a plurality of barrier support members being interconnected end-to-end and being horizontally mounted upon the tubular support members with T-shaped tubular couplers; and also includes a barrier member such as a curtain which is removably mounted to the barrier support members and which has a height of approximately 6 feet and a width of approximately 6 feet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable room divider apparatus which has many of the advantages of the portable and height adjustable room divider mentioned heretofore and many novel features that result in a new portable room divider apparatus which is not anticipated, rendered obvious, suggested, or even implied by any of the prior art portable and height adjustable room divider, either alone or in any combination thereof.

It is another object of the present invention to provide a new portable room divider apparatus which may be easily and efficiently manufactured and marketed.

It is a further object of the present invention to provide a new portable room divider apparatus which is of a durable and reliable construction.

An even further object of the present invention is to provide a new portable room divider apparatus which is susceptible of a low cost of manufacture with regard to both materials and labor, and which accordingly is then susceptible of low prices of sale to the consuming public, thereby making such portable room divider apparatus economically available to the buying public.

Still yet another object of the present invention is to provide a new portable room divider apparatus which provides in the apparatuses and methods of the prior art some of the advantages thereof, while simultaneously overcoming some of the disadvantages normally associated therewith.

Still another object of the present invention is to provide a new portable room divider apparatus for providing privacy in any room, in particular, in any hotel and motel room.

Yet another object of the present invention is to provide a new portable room divider apparatus which includes a base having a pair of elongate members and a cross member removably interconnecting the elongate members; and also includes a plurality of tubular support members interconnected to the base with T-shaped tubular couplers and interconnected end-to-end with one another with sleeve-like tubular couplers; and further includes a plurality of barrier support members being interconnected end-to-end and being horizontally mounted upon the tubular support members with T-shaped tubular couplers; and also includes a barrier member such as a curtain which is removably mounted to the barrier support members and which has a height of approximately 6 feet and a width of approximately 6 feet.

Still yet another object of the present invention is to provide a new portable room divider apparatus that can be effectively and easily set up within minutes.

Even still another object of the present invention is to provide a new portable room divider apparatus that can be conveniently assembled and disassembled within minutes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
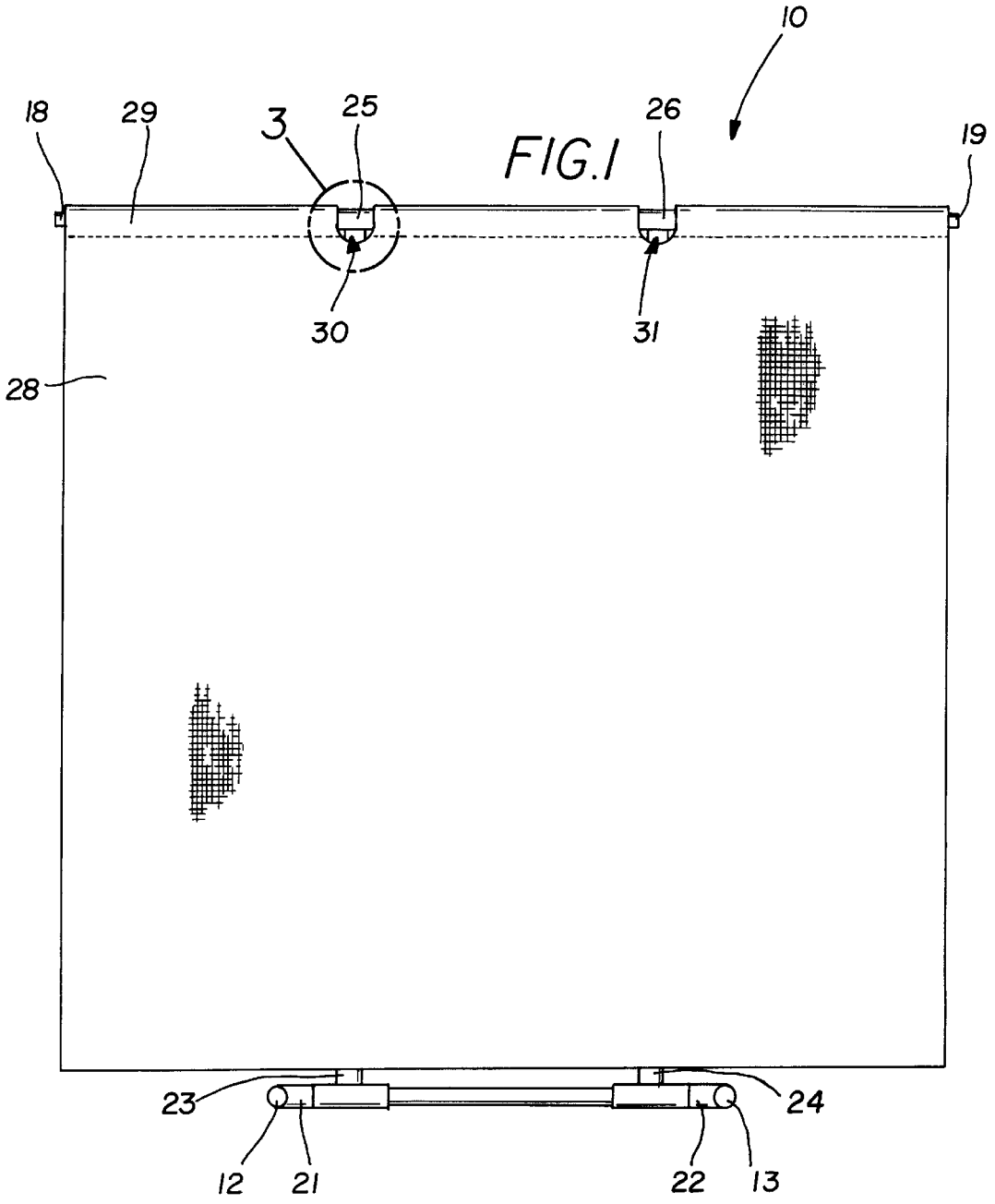
FIG. 1 is a front elevational view of a new portable room divider apparatus according to the present invention.
Figure 2:
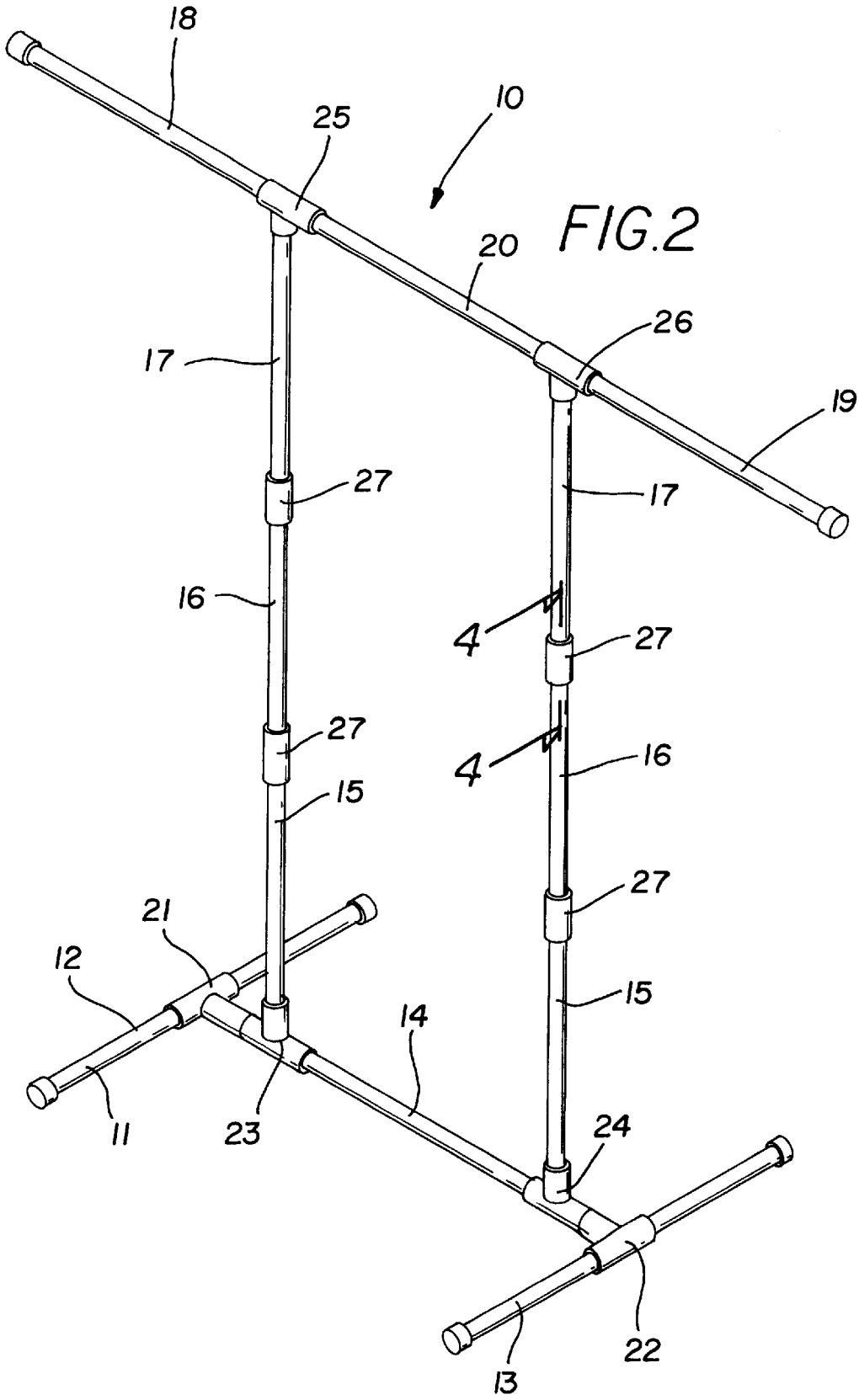
FIG. 2 is a perspective view of the present invention.
Figure 3:
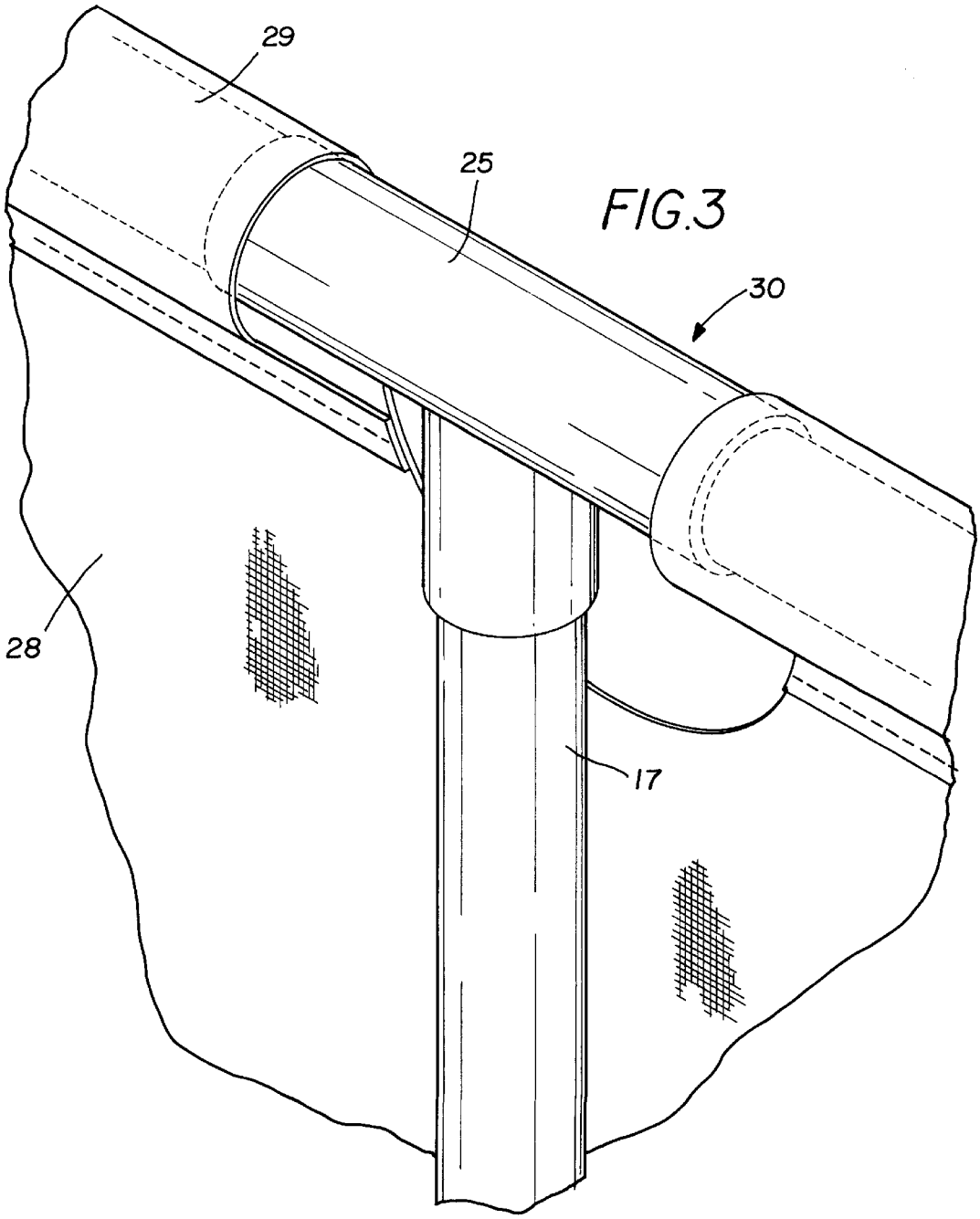
FIG. 3 is a detailed perspective view of barrier member and the barrier support member of the present invention.
Figure 4:
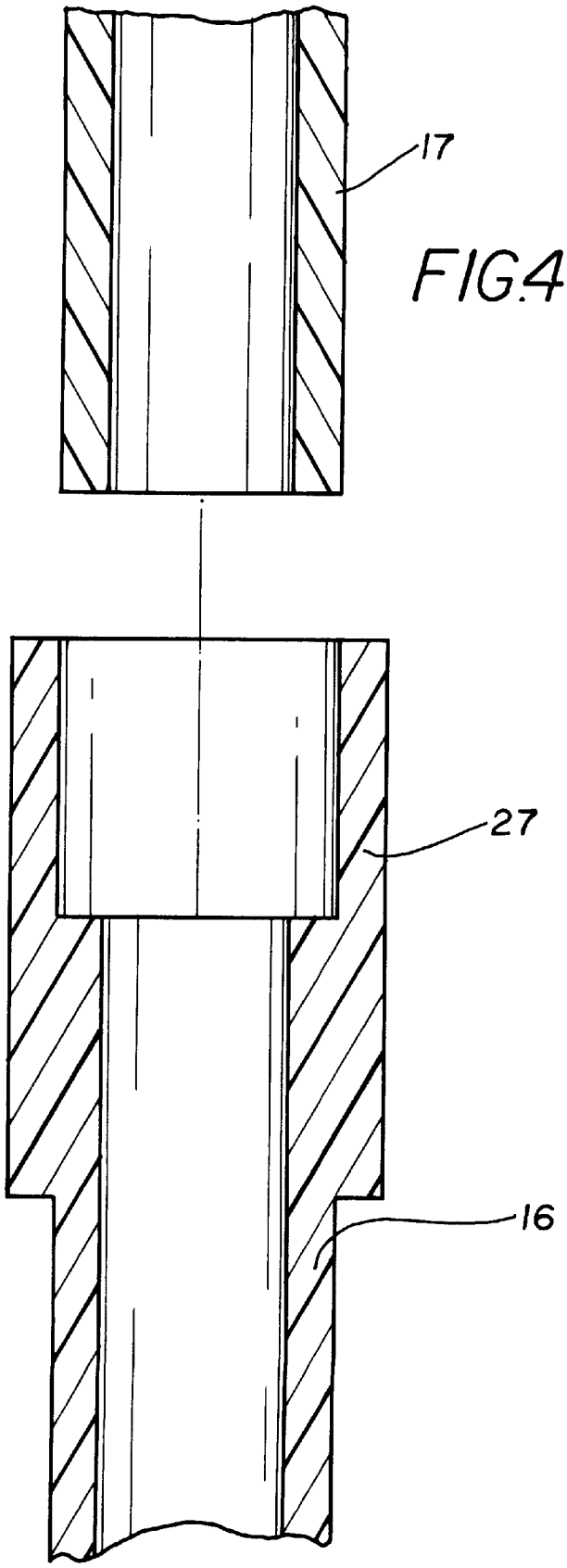
FIG. 4 is a detailed cross-sectional view of one of the couplers of the present invention.

With reference now to the drawings, and in particular to FIGS. 1 through 4 thereof, a new portable room divider apparatus embodying the principles and concepts of the present invention and generally designated by the reference numeral 10 will be described.

As best illustrated in FIGS. 1 through 4, the portable room divider apparatus 10 generally comprises a base 11 including a pair of horizontally-disposed elongate members 12,13 and a cross member 14 detachably interconnecting and extending between the horizontally-disposed elongate members 12,13, and also comprises a plurality of tubular support members 15,16,17 a first two 15 of which are detachably mounted upon the base 11 and extend upwardly therefrom. A plurality of barrier support members 18–20 are detachably mounted and horizontally disposed upon the tubular members 15–17. A barrier member 28 is removably mounted to the barrier support members 18–20 with the barrier member 28 having a height of approximately 6 feet and a width of approximately 6 feet. A plurality of couplers 21–27 interconnects all the members 12–20 together. The couplers 21–27 include a plurality of T-shaped tubular couplers 21–26 a first 21 of which is movably mounted about a first one 12 of the horizontally-disposed elongate members 12,13 and a second 22 of which is movably mounted about a second one 13 of the horizontally-disposed elongate members 12,13 with the cross member 14 having ends which are removably and securely inserted in the first one 21 and the second one 22 of the T-shaped tubular couplers 21–26. The T-shaped tubular couplers 21–26 further include a third 23 and a fourth 24 of which are movably mounted about the cross member 14 with the first two 15 of the tubular support members 15–17 having first ends which are removably and securely inserted in the third 23 and fourth 24 T-shaped tubular couplers. The couplers 21–27 further include a plurality of sleeve-like couplers 27 which interconnects the tubular support members 15–17 end-to-end. The tubular support members 15–17 include a second two 16 of which each is interconnected end-to-end with a respective one of the first two 15 of the tubular support members and extend upwardly therefrom. The tubular support members 15–17 also include a third two 17 of which each is interconnected end-to-end with a respective one of the second two 16 of the tubular support members 15–17 and extend upwardly therefrom. The T-shaped tubular couplers 21–26 include a fifth 25 and a sixth 26 T-shaped tubular couplers securely and removably interconnecting the barrier support members 18–20 end-to-end with each of the fifth 25 and sixth 26 T-shaped tubular coupler being removably and securely mounted upon an end of a respective one of the third two 17 of the tubular support members 15–17. The barrier support members 18–20 include an intermediate support member 20 and a pair of end support members 18,19 each having an end which is interconnected to a respective end of the intermediate support member 20. The barrier member 28 has a looped top end 29 which is adapted to receive the barrier support members 18–20 therein: The looped top end 29 of the barrier member 28 includes a plurality of cutouts 30,31 disposed where the fifth 25 and sixth 26 tubular support members are located with the barrier member 28 being essentially a curtain.

In use, the user inserts the barrier support members 18–20 in the looped top end 29 of the barrier member 28 and then interconnects the members 12–20 by using the couplers 21–27 and places the portable room divider apparatus 10 in the desired or selected location of the room to essentially partition off the room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable room divider apparatus comprising:

a base including a pair of horizontally-disposed elongate members and a cross member detachably interconnecting and extending between said horizontally-disposed elongate members;

a plurality of tubular support members, a first two of said support members being detachably mounted upon said base and extending upwardly therefrom;

a plurality of barrier support members detachably mounted and horizontally disposed upon said tubular members;

a barrier member having a top edge, said top edge of said barrier member being removably mounted to and suspended from said barrier support members, said barrier member having a bottom edge suspended below said top edge, said bottom edge of said barrier member being free of said barrier support members such that said bottom edge is movable for movement of a barrier member by a person; and a plurality of couplers for interconnecting said members together.

2. A portable room divider apparatus as described in claim 1, wherein said couplers includes a plurality of T-shaped tubular couplers a first of which is movably mounted about a first one of said horizontally-disposed elongate members and a second of which is movably mounted about a second one of said horizontally-disposed elongate members with said cross member having ends which are removably and securely inserted in said first one and said second one of said T-shaped tubular couplers.

3. A portable room divider apparatus as described in claim 2, wherein said T-shaped tubular couplers further include a third and a fourth of which are movably mounted about said cross member with said first two of said tubular support members having first ends which are removably and securely inserted in said third and said fourth of said T-shaped tubular couplers.

4. A portable room divider apparatus as described in claim 1, wherein said couplers further includes a plurality of sleeve couplers which interconnects said tubular support members in a linear pattern.

5. A portable room divider apparatus as described in claim 1, wherein said tubular support members include a second two of which each is interconnected end-to-end with a respective one of said first two of said tubular support members and extends upwardly therefrom.

6. A portable room divider apparatus as described in claim 5, wherein said tubular support members include a third two of which each is interconnected end-to-end with a respective one of said second two of said tubular support members and extends upwardly therefrom.

7. A portable room divider apparatus as described in claim 3, wherein said T-shaped tubular couplers include a fifth and a sixth T-shaped tubular couplers securely and removably interconnecting said barrier support members end-to-end with each of said fifth and sixth T-shaped tubular coupler being removably and securely mounted upon an end of a respective one of said third two of said tubular support members.

8. A portable room divider apparatus as described in claim 7, wherein said barrier support members include an intermediate support member and a pair of end support members each having an end which is interconnected to a respective end of said intermediate support member.

9. A portable room divider apparatus as described in claim 1, wherein said barrier member has a looped top end which is adapted to receive said barrier support members therein.

10. A portable room divider apparatus as described in claim 9, wherein said looped top end of said barrier member includes a plurality of cutouts disposed which said fifth and sixth tubular support members are located.

11. A portable room divider apparatus as described in claim 1, wherein said barrier member is a panel comprising a curtain.

12. A portable room divider apparatus comprising:

a base including a pair of horizontally-disposed elongate members and a cross member detachably interconnecting and extending between said horizontally-disposed elongate members;

a plurality of tubular support members a first two of which are detachably mounted upon said base and extending upwardly therefrom;

a plurality of barrier support members detachably mounted and horizontally disposed upon said tubular members;

a barrier member removably mounted to said barrier support members; and a plurality of couplers for interconnecting said members together, said couplers including a plurality of T-shaped tubular couplers a first of which is movably mounted about a first one of said horizontally-disposed elongate members and a second of which is movably mounted about a second one of said horizontally-disposed elongate members with said cross member having ends which are removably and securely inserted in said first one and said second one of said T-shaped tubular couplers, said T-shaped tubular couplers further including a third and a fourth of which are movably mounted about said cross member with said first two of said tubular support members having first ends which are removably and securely inserted in said third and said fourth of said T-shaped tubular couplers, said couplers further including a plurality of sleeve couplers which interconnects said tubular support members end-to-end, said tubular support members including a second two of which each is interconnected end-to-end with a respective one of said first two of said tubular support members and which extend upwardly therefrom, said tubular support members including a third two of which each is interconnected end-to-end with a respective one of said second two of said tubular support members and which extend upwardly therefrom, said T-shaped tubular couplers including a fifth and a sixth T-shaped tubular couplers securely and removably interconnecting said barrier support members end-to-end with each of said fifth and sixth T-shaped tubular coupler being removably and securely mounted upon an end of a respective one of said third two of said tubular support members, said barrier support members including an intermediate support member and a pair of end support members each having an end which is interconnected to a respective end of said intermediate support member, said barrier member having a looped top end which is adapted to receive said barrier support members therein, said looped top end of said barrier member including a plurality of cutouts disposed which said fifth and sixth tubular support members are located, said barrier member being a curtain.

* * * * *